US005806356A

United States Patent [19]

Lee

[11] Patent Number: 5,806,356

[45] Date of Patent: Sep. 15, 1998

[54] KEY HOLDER

[76] Inventor: Chih-Tsun Lee, P.O. Box 82-144, Taipei, Taiwan

[21] Appl. No.: 898,291

[22] Filed: Jul. 22, 1997

[51] Int. Cl.[6] ..... A47G 29/10

[52] U.S. Cl. ..... 70/456 R; 70/459; 206/38.1; 206/37.1

[58] Field of Search ..... 70/459, 456 R, 70/456 B, 457, 458; 24/643, 644, 645, 652, 3 K; 206/37.1, 37.5, 37.6, 37.8, 38.1

[56] References Cited

U.S. PATENT DOCUMENTS

| | | | |
|---|---|---|---|
| 241,502 | 5/1881 | Miller | 70/456 R |
| 1,165,882 | 12/1915 | Killion | 70/456 R |
| 2,307,808 | 1/1943 | Segal | 70/459 |
| 3,009,350 | 11/1961 | Haynes | 70/456 R |
| 4,512,168 | 4/1985 | Reitze | 70/456 R |
| 4,584,858 | 4/1986 | Wolter | 70/456 R |
| 4,821,543 | 4/1989 | Scungio | 70/456 R |
| 4,984,442 | 1/1991 | Benson | 70/459 |
| 5,050,414 | 9/1991 | Huang | 70/456 R |
| 5,209,090 | 5/1993 | Stillwagon | 70/456 R |
| 5,224,366 | 7/1993 | Huang | 70/456 R |
| 5,477,714 | 12/1995 | Bishop | 70/456 R |

*Primary Examiner*—Darnell M. Boucher
*Attorney, Agent, or Firm*—A & J

[57] ABSTRACT

An improved key holder includes a seat with curved edges and three corners, a plurality of key-rings, and a push button at the center of the seat. The key-rings have notches and indentations. The push button has insert plates that may engage the notches of the key-rings. A reset spring is disposed below the push button. Chambers accommodating balls and springs are disposed in the corners of the seat for positioning the indentations of the key-rings. The key-rings may hold more keys and allow easy insertion or removal of keys. Besides, the key holder may be attached to the user's clothing or accessories.

1 Claim, 3 Drawing Sheets

KEY HOLDER

BACKGROUND OF THE INVENTION

1. Field of the Invention

This invention relates generally to a key holder, and more particularly to a key holder which may hold a greater number of keys and the keys may be inserted or removed with ease.

2. Description of the Prior Art

FIG. 1 illustrates a conventional key-ring. It essentially comprises an elastic split ring 3 of several coils for holding keys. A short chain 2 connects the split ring 3 to a decorative tag 1. With this structure, every time the user wants to put a key onto the split ring 3, he/she has to push away one end of the split ring 3 a certain distance with his/her fingers and holds it there so that the key can fit onto that end of the split ring 3. The user then has to push the key along the coils of the split ring 3 until it passes through the other end of the split ring 3 and well within the split ring 3. This way of inserting keys onto the split ring 3 is not only troublesome, but it may also hurt his/her fingers or fingernails.

Furthermore, such a key-ring structure can only keep a small number of keys, and cannot be attached to the user's clothing such as the ears at the waist of pants or the belts. Keys may be easily lost in this way. These long felt problems demand an improved key-ring structure.

SUMMARY OF THE INVENTION

This invention relates generally to a key holder, and more particularly to a key holder which may hold a greater number of keys and the keys may be inserted or removed with ease.

A primary object of the present invention is to provide an improved key holder that may hold more keys and allow easy insertion or removal of keys. In order to achieve this object, the key holder of the present invention comprises a seat with curved sides and three corners, a plurality of key-rings with notches and indentations, and a push button disposed at the center of the seat. Slide grooves are provided in the seat at the curved edges. The push button may be operable to engage notches of the key-rings, and a reset spring is disposed below the push button. Recesses are disposed in the seat at the corners for accommodating balls and springs for urging against the indentations of the key-rings.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

DETAILED DESCRIPTION OF THE PREFERRED EMBODIMENT

Figure 1:
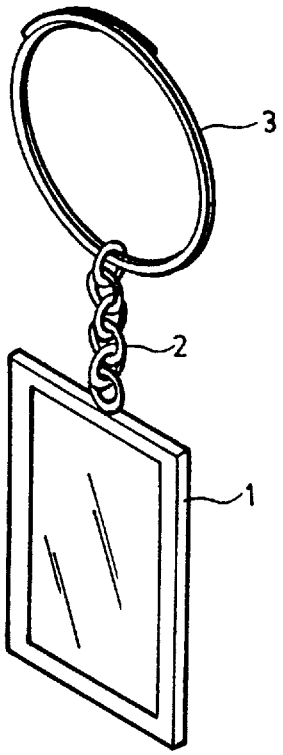
PRIOR ART FIG. 1
FIG. 1 is a perspective view of the prior art.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
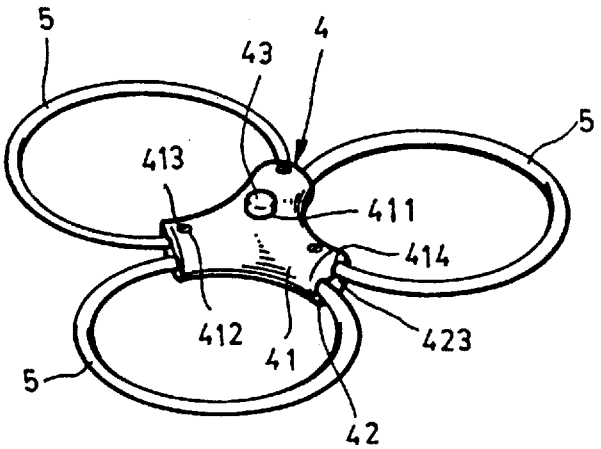
FIG. 2 is a perspective view of the key holder of the present invention.
Figure 3:
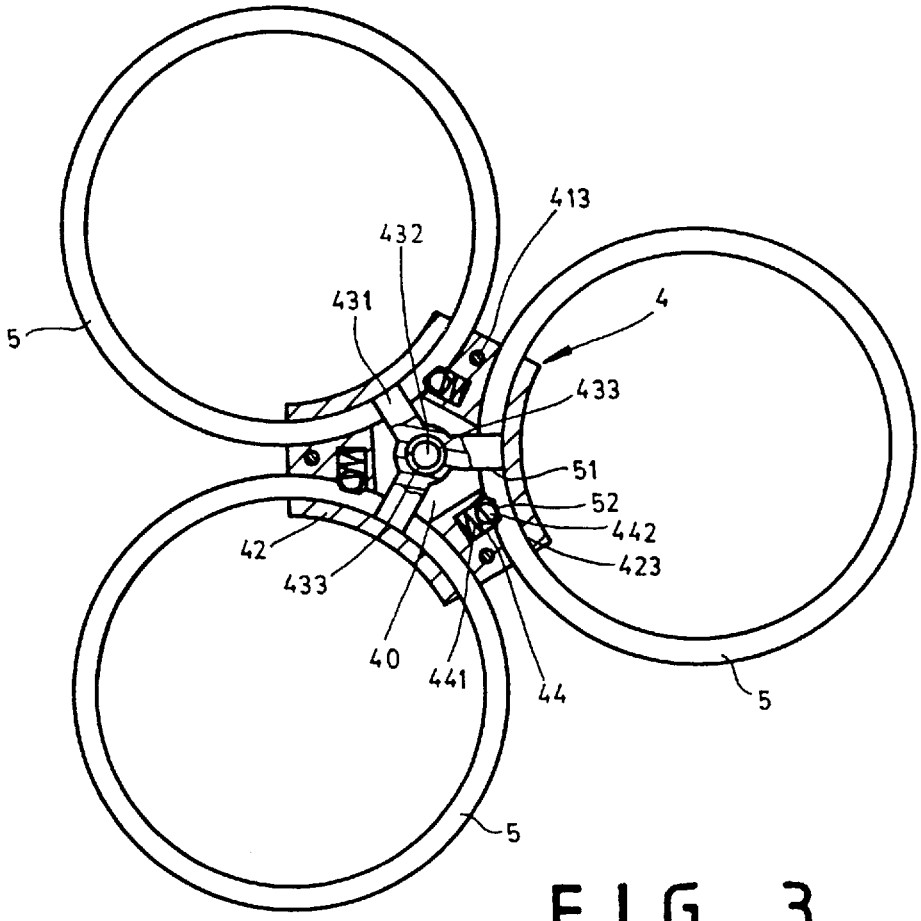
FIG. 3 is a cross-sectional view of the present invention.

With reference to FIGS. 2 and 3, which show a preferred embodiment of the present invention, the key holder essentially comprises a seat 4, a plurality of key-rings 5, and a push button 43. The seat 4 comprises an upper seat portion 41, and a lower seat portion 42. In this preferred embodiment, the seat 4 is substantially triangular with curved edges, and the upper seat portion 41 is provided with a through hole 412 at each corner for passage of a screw 413, while the lower seat portion 42 is provided with a screw hole 422 at each corner for receiving the screw 413 passing through the through hole 412 thereabove. In order that keys 6 may fit into the key-rings 5, slide grooves 414, 423 are provided within the curved edges of the upper and lower seat portions 41, 42, while the key-rings 5 are provided with respective notches 51 at the joint and respective indentations 52 at the other side. The indentations 52 facilitate positioning of balls 442 urged by springs 441 within respective chambers 44 at the respective angles of the lower seat portion 42 and prevent slippage of the keys 6. The upper seat portion 41 is provided with a central hole 411 through which the push button 43 may extend. The push button 43 has insert plates 431 which are rotatable within a receiving chamber 40 of the lower seat portion 42 for resetting purposes. Besides, the push button 43 has a reset spring 433 disposed below, the reset spring 433 has the other end urging a recess 421 of the lower seat portion 42.

Figure 4:
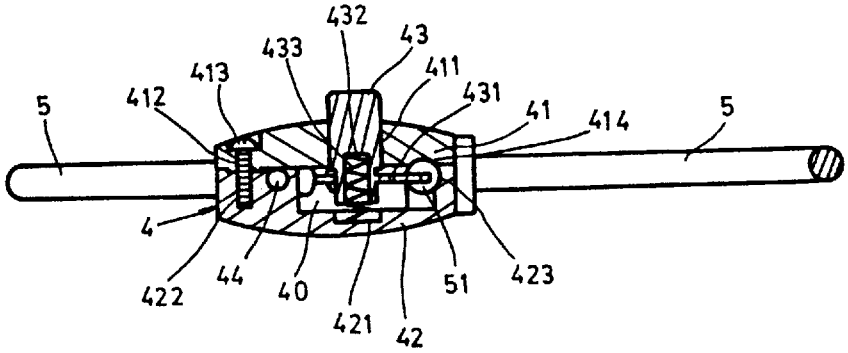
FIG. 4 is a longitudinal section of the present invention when the push button is not yet pressed.

Reference is made to FIG. 4, which shows the push button 43 when not being pressed. The push button 43 remains up when the keys 6 are held on the key holder of the present invention. The insert plates 431 disposed below the push button 43 act with the notches 51 of the key-rings 5. When the insert plates 431 are urged by the reset spring 433 when the latter resets, the insert plates 431 displace upwardly and engage the notches 51. At the same time, the springs 441 within the chambers 44 of the lower seat portion 42 urge the balls 442 against the indentations 52 at the outer side of the key-ring 5 so that the notches 51 of the key-ring 5 are engaged. With the balls 442 urging against the indentations 52, the keys 6 will certainly not slip out.

Figure 5:
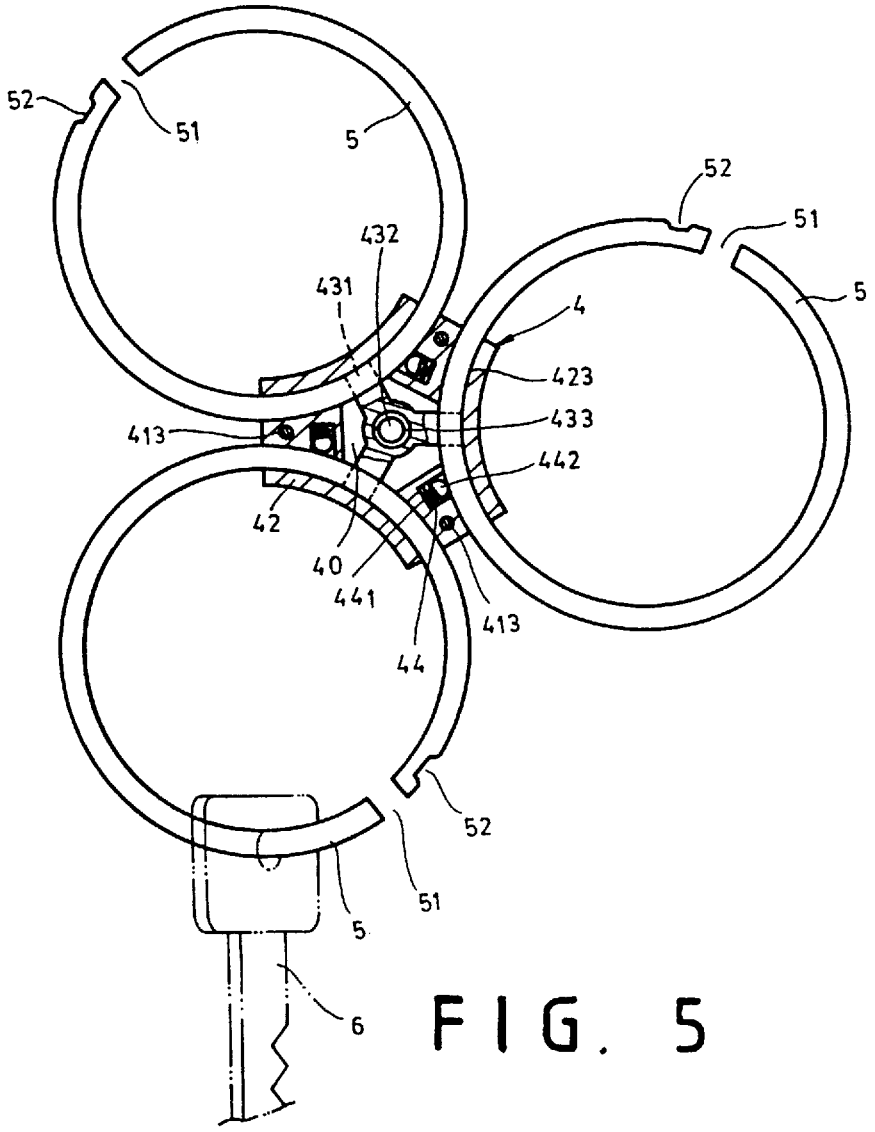
FIG. 5 illustrates the key holder of the invention with the keys.
Figure 6:
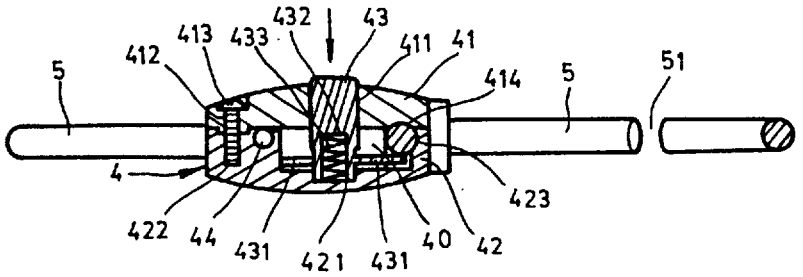
FIG. 6 is a longitudinal section of the present invention with the push button pressed.

When it is desirable to remove a key 6 or put in a new key 6 (see FIGS. 5 and 6), the push button 43 is pressed downwardly so that the insert plates 431 acting upon the notches 51 of the key-rings 5 are actuated and the springs 433 therebelow are compressed, accumulating the resetting force. At this point, the key-rings 5 may slide along the opposed slide grooves 414, 423 of the seat 4 so that the notches 51 move away from the seat 4. At this point, the notches 51 are oriented outwardly so that keys 6 may be removed or inserted. When the key-rings 5 are not returned to their original position, the insert plates 431 are being pressed inside the receiving chamber 40 below the key-rings 5. When the notches 51 are rotated to the seat 4, the balls 442 will engage the indentations 52 and generate a snap sound to indicate that the key-rings 5 are properly positioned. When all the key-rings 5 are positioned, the insert plates 431 will automatically elevate due to the resetting action of the spring 433. In other words, the insert plates 431 displace to the notches 51 of the key-rings 5 so that the key-rings 5 are again positioned.

As can be seen from the above, the key holder of the present invention is easy to use and will not hurt the user's fingers or fingernails during placement or removal of keys. Besides, any one of the key-rings may be attached to the user's belt, hand-bag, etc., and may not be easily lost.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A key holder, comprising a seat, a plurality of key-rings, and a push button, wherein said seat comprises an upper seat portion and a lower seat portion, and is internally provided with corresponding slide grooves at at each side, said slide grooves accommodating therein said key-rings, said key-rings having respective notches and indentations, said push button being exposed at a center of said upper seat portion and having insert plates therebelow and within a receiving chamber of said lower seat portion, said insert plates capable of engaging said notches of said key-rings, a recessed seat being disposed below an interior of said push button for accommodating a reset spring that acts upon a recess of said lower seat portion, said seat having three corners provided with respective chambers in which balls and urging springs are disposed, for engaging positioning said indentations of said key-rings, whereby when said push button is pressed and said key-rings are rotated or reset, keys may be easily removed or inserted.

* * * * *